US006293433B1

(12) United States Patent
Joulia

(10) Patent No.: US 6,293,433 B1
(45) Date of Patent: Sep. 25, 2001

(54) DISPENSING DEVICE AND METHOD FOR SEPARATELY STORING COMPONENTS AND MIXING THE COMPONENTS

(75) Inventor: Gérard Joulia, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/667,613

(22) Filed: Sep. 22, 2000

(30) Foreign Application Priority Data

Sep. 22, 1999 (FR) ..... 99 11832

(51) Int. Cl.[7] ..... B67D 5/56

(52) U.S. Cl. ..... 222/129; 215/DIG. 8; 206/221

(58) Field of Search ..... 222/1, 541.6, 541.1, 222/541.2, 129; 215/DIG. 8; 206/221, 219; 604/82, 89, 91

(56) References Cited

U.S. PATENT DOCUMENTS

Re. 29,062 * 12/1976 Ogle ..... 604/91
4,632,244 * 12/1986 Landau ..... 206/219
5,088,627 2/1992 Musel ..... 222/145
5,817,055 * 10/1998 Ljungquist ..... 604/89
5,875,889 * 3/1999 Albisetti ..... 206/221
6,189,688 * 2/2001 Aneas ..... 206/219

FOREIGN PATENT DOCUMENTS 79 23 456 11/1979 (DE) .

* cited by examiner

*Primary Examiner*—Kevin Shaver
*Assistant Examiner*—Patrick Buechner
(74) *Attorney, Agent, or Firm*—Finnegan, Henderson, Farabow, Garrett & Dunner, LLP

(57) ABSTRACT

A dispensing device for dispensing a mixture of at least two components comprises a container body defining at least two compartments kept sealed from one another by a stopper member prior to dispensing the mixture. An actuator operably coupled to the stopper member selectively places the stopper member in a storage position in which the two compartments are sealed from one another and in a mixing position in which the two compartments are in flow communication with one another. The stopper member has a lateral cross-section that is larger in the storage position than in the mixing position. The dispensing device can be used for packaging and applying components that should not be mixed until they are ready to be dispensed.

66 Claims, 4 Drawing Sheets

DISPENSING DEVICE AND METHOD FOR SEPARATELY STORING COMPONENTS AND MIXING THE COMPONENTS

The present invention relates to a device for separately storing two components, mixing them, and then dispensing the mixture.

Known devices exist that separately store two components which are to be mixed together prior to dispensing and use.

For example, U.S. Pat. No. 5,088,627 discloses a device comprising a multi-chambered container, a tubular member acting as a plug for separating the chambers prior to first use, a nozzle, and a threaded cap. Opening of the cap moves the tubular member axially with respect to the container body so as to cause the two compartments to communicate. The two-compartment container is formed as a single piece structure with a transition zone of smaller cross section provided between the two compartments. Thus, a restriction is formed in the device and acts as a seat for the tubular member before the products in the two compartments are mixed. To mix the products in the two compartments, the tubular member is moved axially out of engagement with the transition zone between the two compartments.

Some existing devices have certain drawbacks. In particular, the container body may be difficult to produce, particularly if it is intended to contain a component that may limit the choice of materials from which the container can be made and/or the manufacturing techniques that can be employed. In particular, fitting a plug-like member in a sealed manner in a restricted region of the body may prove somewhat unreliable if the body is produced by injection blow-molding. This technique may result in large tolerances on the interior cross section of the restricted region that are intolerable for the sealed fitting of a rigid plug.

An object of the present invention is to provide a device for separately storing at least two components prior to dispensing, for selectively mixing the components, and for dispensing a mixture of the components. A further object of the invention is to provide such a device that is relatively easy and simple to manufacture and that is reliable. Preferably, the device will be suited for the packaging of at least two components, at least one of which may be irritant or corrosive.

Products intended to be stored in the device of the present invention include, for example, hair dyes which work by oxidation, perming products, and the like. These types of products customarily comprise at least two components, one of which includes a strong oxidizing or reducing agent which, if brought into contact with the other component inadvertently prior to use, causes degradation of the product.

It should be understood that the invention could still be practiced without performing one or more of the preferred objects or advantages set forth above. Still other objects of the present invention will become clear from the detailed description of the preferred embodiments which will be explained shortly.

A first aspect of the invention includes a device for dispensing a mixture of at least two components, comprising a container body defining at least two compartments and a stopper member configured to selectively seal the two compartments from one another and place the two compartments in flow communication with one another. The device further includes an actuator operably coupled to the stopper member and configured to selectively place the stopper member from a storage position in which the two compartments are sealed from one another, to a mixing position in which the two compartments are in flow communication with one another. The stopper member has a transverse cross-section in the storage position that is larger than a transverse cross-section of the stopper member in the mixing position.

According to another aspect of the invention, the stopper member of the device has a height that is smaller in the storage position than a height of the stopper member in the mixing position.

According to yet another aspect of the invention, at least a portion, and preferably the bottom, of the stopper member of the device remains in approximately the same axial position relative to the container body in both the storage and mixing positions. Preferably, another portion of the stopper member moves axially with respect to the container body to place the stopper member in the storage and mixing positions.

Preferably, the stopper member may include an elastically deformable element and the actuator is configured to apply axial compression to the stopper member to place the stopper member in the storage position. The axial compression causes an increase in the cross-section of the stopper member relative to a cross-section of the stopper member absent the axial compression. The increase in cross-section of the stopper member places a lateral surface of the stopper member in sealing engagement with an inner portion of the container body. The diameter of the stopper member absent axial compression preferably is less than an inner diameter of the container body at an axial location corresponding to the stopper member.

Preferably, a first movement of at least a portion of the actuator places the stopper member in the storage position and a second movement of the actuator opposite to the direction of the first movement places the stopper in the mixing position. The actuator may further include two compression elements, with at least one of the compression elements configured to move axially relative to the other compression element. The stopper member is disposed between the two compression elements. In a preferred embodiment, the compression elements are in the form of plates having a diameter less than an inner diameter of the container body.

The actuator may include a rotatable opening/closure member whereby the first movement rotates the opening/closure member in a first direction and the second movement rotates the opening/closure member in the second opposite direction. The rotatable opening/closure member may be coupled to compression elements for axially compressing and decompressing the stopper member in response to rotation of the rotatable closure. The device may be provided with a stop mechanism configured to limit rotation of at least one of the compression elements with respect to the container body.

At least a portion of the actuator preferably is configured to move axially with respect to both the container body and the stopper member. The actuator may include a threaded portion configured to be in threaded engagement with the container body. Preferably, the threaded portion is configured to rotate with respect to the container body in a first direction to place the stopper in the storage position and in a second direction to place the stopper in the mixing position. Rotation of the threaded portion with respect to the container body may impart axial motion to at least a portion of the actuator relative to both the container body and to the stopper member. The actuator may include compression elements configured to selectively compress and decompress the stopper member in response to the axial motion.

One of the compartments may be in flow communication with an outlet orifice configured to dispense the mixture. The device may further include a hollow stem configured to place at least one of the compartments in flow communication with the outlet orifice. Preferably, the stem communicates with the at least one compartment through at least one opening formed on an outer surface of the stem. In a preferred embodiment, the actuator includes the stem.

A dispensing attachment in flow communication with one of the compartments of the device may be provided. The dispensing attachment preferably is equipped with an outlet duct. The dispensing attachment can be closed by a removable or break-off tab, or by a removable cap, such as, for example, a screw cap. The stem preferably extends in the form of a neck delimiting an open free end on which the dispensing attachment is mounted. The stem preferably communicates with the compartment by means of at least one slot provided on an exterior portion of the stem. This slot preferably may extend over practically the entire height of the stem.

Preferably, the container body has an interior having a substantially cylindrical shape having an approximately uniform cross-section. Through this arrangement it is possible, in a container formed as a single piece, to form two compartments aligned with one another and sealed from one another by the said elastic stopper member. Such an embodiment may be relatively simple to achieve and is of a low production cost. The container body preferably has a closed bottom and is formed of a single piece of one of rigid material and semi-rigid material. It also is possible to use a bottom which attaches to the container body. A body made of a semi-rigid material has the advantage of being compressible, which, at the time of application, may facilitate the dispensing and the metering of the mixture of components. The container body preferably is made by one of injection blow-molding, extrusion blow-molding, single-material injection molding using polyvinyl chloride, and two-shot injection molding of two appropriate materials. The container body may be made of a polyethylene/polyvinyl alcohol/polyethylene complex. When the body is produced by two-shot injection molding, it preferably comprises an interior layer with a barrier function and an exterior layer providing the body with strength and a desired exterior appearance.

Preferably, the compartments are defined in a unitary, one-piece container body without having separate compartments assembled one on the other. Such a construction preferably maintains the tightness, or sealing, of the assembly. In the preferred embodiment, the container can be formed without a central restriction that is plugged by an axially movable plug. Alternative constructions, however, also are possible. The invention preferably permits relatively simplified manufacture of the device, with a greater choice of manufacturing techniques and materials.

Using the compression elements described above, it may be possible to mount the stopper member between the elements such that it is axially compressible and radially deformable. This modification to the shape of the stopper preferably is reversible in response to an axial decompression caused by moving the actuator. Thus, regardless of the tolerances on the container body, the seat and/or the stopper member need not be specially sized. Rather, dimensional variations in the container body or imperfections on its interior surface may be compensated for automatically.

In other words, when the stopper member is placed into the storage position by the actuator, a peripheral lateral surface of the stopper member sealingly engages an interior surface of a lateral wall of the container. When the stopper member is in the mixing position, flow communication between the two compartments is established between the periphery of the stopper member and the inner surface of the lateral wall of the container body, thus allowing the two components to pass, so that they can be mixed.

The stopper member preferably is made of an elastic material, such as an appropriate elastomer or an elastic foam, for example. As a preference, the elastic material is chosen from natural or synthetic rubbers, and more preferably from nitrile rubbers, butadiene rubbers, Neoprene® (supplied by the company Du Pont), injectable thermoplastic rubbers such as Santoprene® (supplied by Monsanto), silicone rubbers, etc. Preferably, the stopper material is compatible with the two components contained in the reservoir. Moreover, when the stopper member is made of foam, the foam is preferably a closed-cell foam. Such foams include polyethylene foam, polyurethane foam or polyester foam, for example.

The elastic material preferably has a Shore A hardness ranging from approximately 30 to approximately 90.

According to one embodiment of the invention, the opening/closure member and the compression element are coupled to one another by a coupling mechanism that includes, for example, a snap-fastener, or other suitable coupling mechanisms. The opening/closure member may be made as a single piece with the coupling member, preferably by molding, for example.

The dispensing device may be assembled relatively easily. The stopper member, mounted between two compression elements of the actuator, can be placed inside the container after mounting the stem on the coupling member. The opening/closure member of the actuator, preferably is in the form of a single piece and is molded integrally with the stem. Preferably, the opening/closure member has a threaded portion and is screwed into engagement with threads provided on the container body, causing the stem to move down and the compression elements to compress the stopper axially. The radial expansion of the stopper, as a result of this compression, provides the leaktight and reliable separation of the components packaged in the two compartments. It should be noted that, during the assembly operation, at least a portion of the stopper member preferably remains in a fixed axial position.

The device, as will be explained in more detail later, is relatively easy and ergonomical to use.

Another aspect of the invention relates to the use of the device for storing, mixing, and dispensing of a cosmetic composition, for example a hair dye or a hair perming composition. Preferably, using the device includes mixing a hair composition in the device and dispensing the hair composition from the device.

The two compartments of the device may contain cosmetic components, preferably hair compositions.

Yet another aspect of the invention includes a method of using the device, comprising providing a first component in the first compartment and a second component in the second compartment and maintaining the compartments sealed from one another. The method further includes placing the first and second compartments in flow communication with one another by either reducing the cross-section of the stopper member and/or increasing the height of the stopper member, mixing the components together, and dispensing the mixture. In one embodiment, the method includes placing the two compartments in flow communication while at least a portion of the stopper member remains at the same axial position relative to the container body.

Reducing the cross-section of the stopper member preferably includes either moving at least a portion of the actuator in a first direction or removing an axial compressive force from the stopper member. The method may further include maintaining the compartments sealed from one another by compressing the stopper member. The actuator may include a rotatable closure and the moving of at least a portion of the actuator may include rotating the closure member with respect to the container body. Preferably, rotating of the closure member causes at least a portion of the actuator to move axially with respect to the container body and the stopper member. The method may further include reducing the cross-section of the stopper member by moving at least one compression element axially with respect to another compression element.

The dispensing device of the invention, which has just been described, may be used for storing and dispensing a cosmetic product, preferably a hair product, pharmaceutical product or dermopharmaceutical product. However, other products requiring dispensing also can be stored and dispensed and would be obvious to those skilled in the art.

Besides the structural and procedural arrangements set forth above, the invention could include a number of other arrangements, such as those explained hereinafter. It is to be understood that both the foregoing description and the following description are exemplary, and are intended to provide further explanation of the invention as claimed. Other features and advantages of the invention will become apparent by reading the following detailed description of an illustrative and non-limiting example, and by examining the appended drawings.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an exploded cross-sectional view of a device according to an aspect of the invention showing the storing of a first component;

Reference will now be made in detail to the present preferred embodiments of the invention, examples of which are illustrated in the accompanying drawings. Wherever possible, the same reference numbers are used in the drawings and the description to refer to the same parts.

Figure 1:
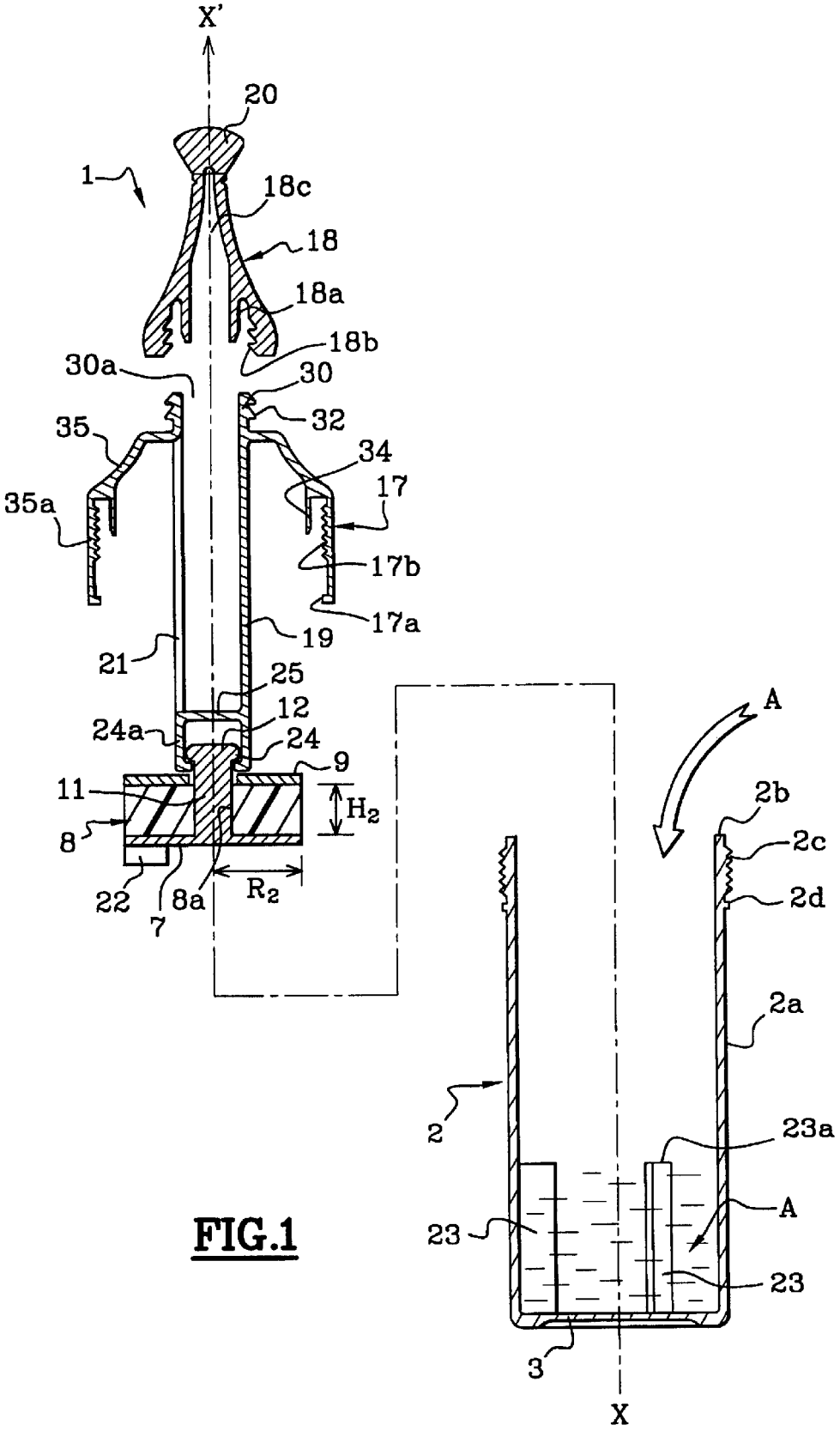
Figure 2:
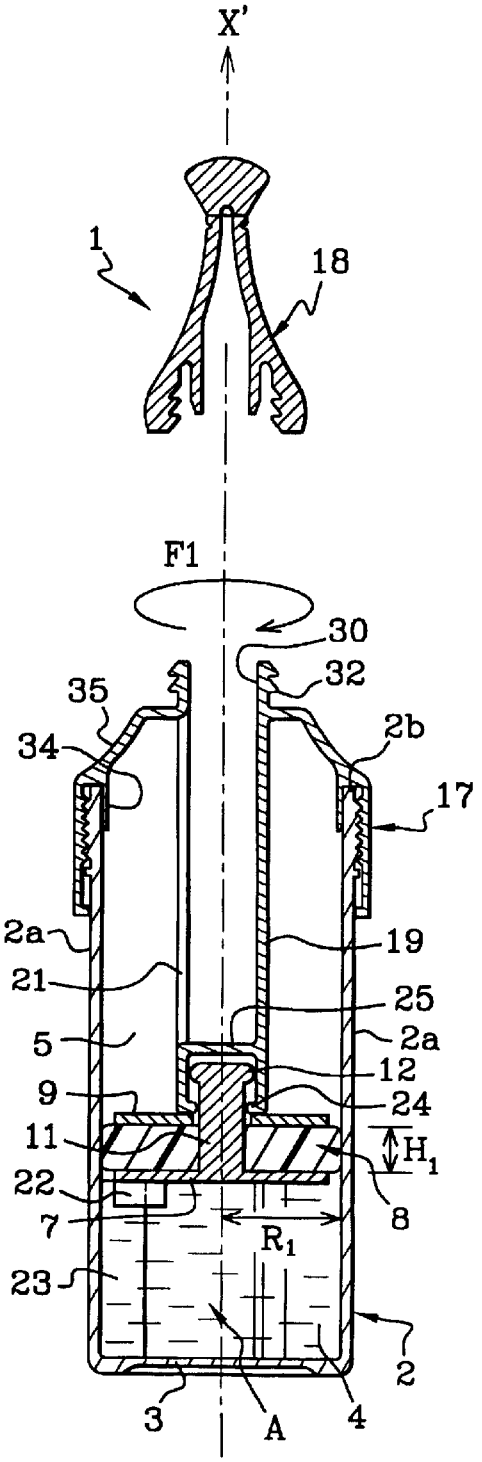
FIG. 2 is cross-sectional view showing the various actuator components of FIG. 1 being mounted together.

FIGS. 1 to 6 show a dispensing device 1 according to a preferred embodiment of the invention. The dispensing device 1 includes an elongate body 2*a* forming a container 2 with a closed bottom 3. The body 2*a* defines a first, lower compartment 4 and a second, higher compartment 5 (shown in FIGS. 2 to 6). An end 2*b* of the container, opposite the bottom 3, is open. Near the open end, the container body 2*a* is provided with an external screwthread 2*c,* preferably disposed on an exterior of the container body 2*a*.

Figure 3:
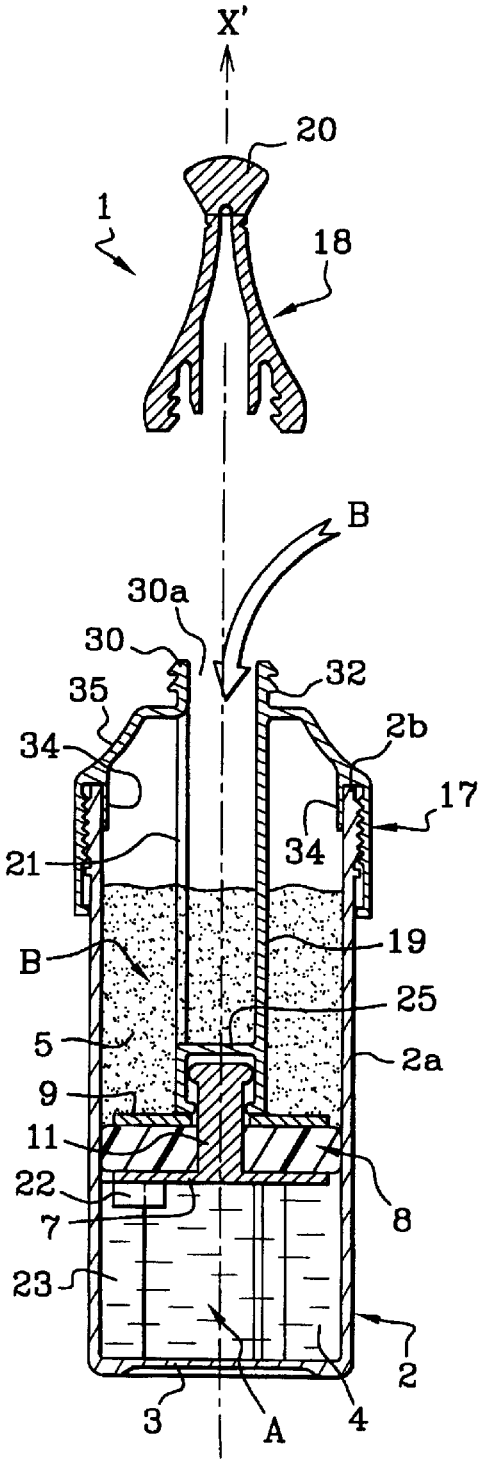
FIG. 3 is a cross-sectional view of the second component being stored in the device of FIG. 1.
Figure 4:
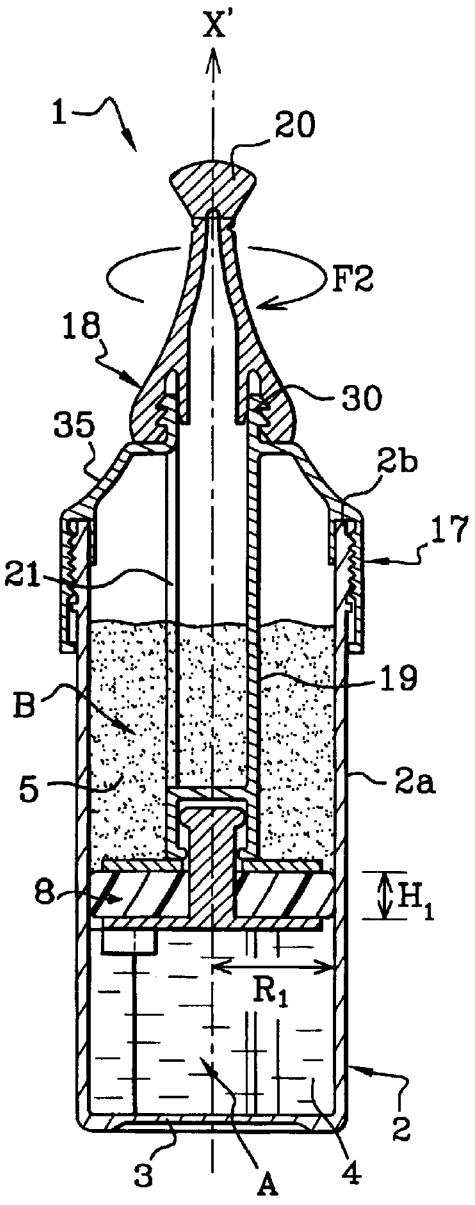
FIG. 4 is a cross-sectional view of the device FIG. 1 shown in the storage position.
Figure 5:
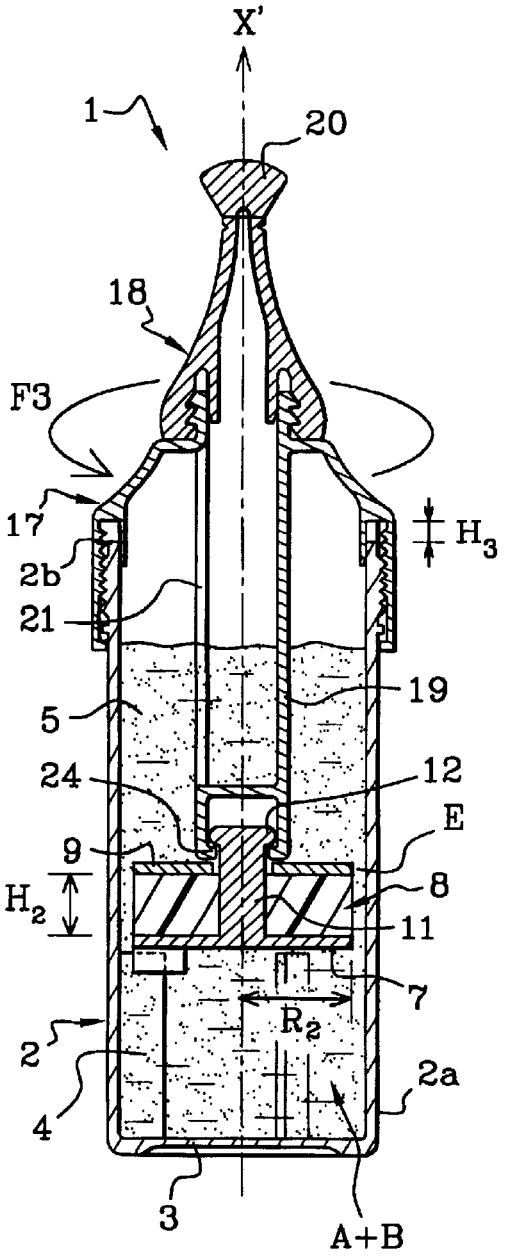
FIG. 5 is a cross-sectional view of the device of FIG. 1 during the mixing of the components.

As shown in FIG. 3, in a storage position, the first and second compartments 4, 5 are separated in a hermetically sealed fashion, by a stopper member 8 disposed inside the container 2. The lateral surface of stopper member 8 is configured to press, in a sealed manner, against an interior surface of the container body 2*a*. Preferably, stopper member 8 is reversibly deformable or compressible.

The first compartment 4 contains a component A, such as, for example, a dye precursor or a reducing agent. The second compartment 5 contains a component B such as, for example, an oxidizing agent. The two components A and B are stored separately until the time of first use. In the embodiment described, the components A and B include two liquids.

According to the embodiment, the body 2*a* has an overall cylindrical shape of revolution about a longitudinal axis X. The interior diameter of the body 2*a* is substantially uniform along the entire length of the container. The body 2*a* may be produced by injection blow-molding or by extrusion blow-molding, of a plastic. Preferably, the plastic is chemically compatible with the components A and B stored in the body 2*a*. Alternatively, the body may be made of glass. By way of example, if one of the components is thioglycolic acid or hydrogen peroxide for producing perms or hair dyes, the body 2*a* preferably will be made of PVC or of a PE/EVOH/PE (polyethylene/polyvinyl alcohol/polyethylene) multilayer complex.

The stopper member 8 may be in the form of an elastic annulus which, in the absence of axial compression exerted thereon, has a thickness or height $H_2$. It may, for example, be made of a closed-cell foam or of a nitrile/butadiene rubber, for example. The stopper member 8 is supported by a rigid base plate 7 having a central peg 11 passing through a central opening 8*a* of the stopper member 8. The top end of the peg 11 forms a bulge 12. The base plate 7 is immobilized from moving axially towards the bottom of the container by fins 23 on the ends of which the plate 7 rests. This causes at least a portion of stopper member 8 also to be prevented from moving axially toward a bottom of the container. An annular plate 9, which is preferably rigid, is placed on the top of the elastic stopper member 8 to sandwich the stopper member 8 between the base plate 7 and the annular plate 9. The base plate 7 and the annular plate 9 are approximately the same size and essentially form compression elements configured to selectively compress and decompress stopper member 8.

When the stopper member 8 is not in axial compression, it also has approximately the same diameter as the base plate 7 and the annular plate 9, which is slightly less than the inner diameter of the body 2*a*. When the base plate 7 and the annular plate 9 are brought closer together due to an axial force, the elastic stopper member 8 compresses and expands radially so that its peripheral or lateral edge presses tightly against the interior surface of the body 2*a* of the container. The lower compartment 4 is thus separated in a leaktight manner from the upper compartment 5. In other words, when the base plate 7 and the annular plate 9 are caused to move axially toward one another, the stopper member 8 is placed in compression, thereby causing a decrease in the stopper's thickness or height (see $H_1$ in FIGS. 2 and 3) and a corresponding radial expansion. Thus, when a subassembly made up of the base plate 7, the elastic stopper member 8, and the annular plate 9 is placed inside the cylindrical container 2, the subassembly essentially constitutes a reversible sealing mechanism.

The bulge 12 of the peg 11 is configured to be engaged with a hollow stem 19 having a laterally opened part on its exterior surface, preferably in the form of at least one axial slot 21. The slot or slots 21 extend over approximately the entire height of the stem 19. The stem 19 is hollow and extends in the form of a cylindrical neck 30 delimiting an opening 30*a* and comprising an external screwthread 32.

The lower part of the stem 19 is closed by a transverse partition 25. The transverse partition 25 bears a number of radially flexible tabs 24*a* distributed uniformly around the periphery of the partition 25. These tabs extend axially toward the annular plate 9 and radially toward the peg 11. The free ends of the tabs 24*a* are shaped into internal hooks 24, which are elastically deformable and capable of gripping onto the bulge 12 of the peg 11. These tabs thus constitute a mechanism for coupling the stopper member 8 and an external opening/closure member 17, as will be explained.

It should be noted that the base plate 7 has on its underside a stop mechanism comprising at least one step 22. The step 22 can come laterally into abutment against one of the anti-rotation fins 23 formed on the interior wall of the lower compartment 4. The height of these fins 23, of which there preferably are three or four disposed around the longitudinal axis of the body 2*a,* determines the volume of the first compartment 4. In effect, as will be explained later, when assembling the device, the base plate 7 sits axially on the fins 23, the upper ends 23*a* of which form an axial stop for the base plate 7, stopper member 8, and the annular plate 9. Upon actuating the opening/closure member 17, the step 22, collaborating with one of the fins 23, prevents the base plate 7, the stopper 8, and the annular plate 9 from rotating.

The upper part of the stem 19 forms a neck 30 of the container that is connected to the opening/closure member 17. The opening/closure member 17 preferably is in the form of a cap 35 configured to be held by the user. The cap 35 can be fit onto the open end 2*b* of the container body 2*a*. For this purpose, an external cylindrical skirt 35*a* has an internal screwthread 17*b* capable of engaging with the external screwthread 2*c* of the container body 2*a*. The exterior skirt 35*a* also has an annular rim 17*a,* shown in FIG. 6, facing toward the axis X and configured, once the cap 35 has been placed on the container, to sit beyond an external annular bead 2*d* formed on the body 2*a* near the screwthread 2*c*. This arrangement essentially constitutes a stop to prevent the cap 35 from being detached from the container 2 by the user. An internal sealing skirt 34 also is provided and configured to press radially against the interior wall of the container 2.

The opening/closure member 17 is mounted by screwthreads 2*c* and 17*b* such that it can both rotate and axially translate with respect to the body 2 so as to allow the user to act on the base plate 7 and annular plate 9, essentially forming an actuator assembly. It is thus possible selectively to compress or decompress the stopper member 8, and to vary the stopper's height and thereby vary the stopper's radius (i.e., $R_1$ in the storage position and $R_2$ in the mixing position, $R_1$ being greater than $R_2$).

In effect, when mounting the opening/closure member 17 by screwing the cap 35 on, axial pressure is exerted by the tabs 24*a* of the stem 19 on the annular plate 9. Consequently, the stopper member 8 is compressed axially and expands radially to a radius $R_2$. At this point, the stopper member 8 is in the storage position. Under the effect of the radial expansion of the stopper, its peripheral edge presses against the interior wall of the container body 2*a,* thus hermetically separating and sealing the compartments 4 and 5 from one another.

When the opening/closure member 17, as a result of partially unscrewing the cap 35, no longer exerts an axial force on the compression elements 7, 9, the stopper member 8 contracts radially to a radius $R_2$. In this configuration, the stopper member is in the mixing position. Thus, an annular space E is created between the interior wall of the container body 2*a* and the lateral surface of the stopper member 8. This annular space E places the two compartments 4 and 5 in flow communication with each other, allowing the components A and B to be mixed.

An applicator and dispensing attachment 18 is fitted onto the cap 35 such that it is in flow communication with the inside of hollow stem 19. The dispensing attachment 18 defines an outlet duct 18*c* configured to be closed at one end by a removable closure tab 20, or the like. In addition, the interior of the stem 19 is in flow communication with the surrounding second compartment 5 via the slot or slots 21.

By shaking the device after opening the user can make the mixing of the components A and B more homogeneous.

Figure 6:
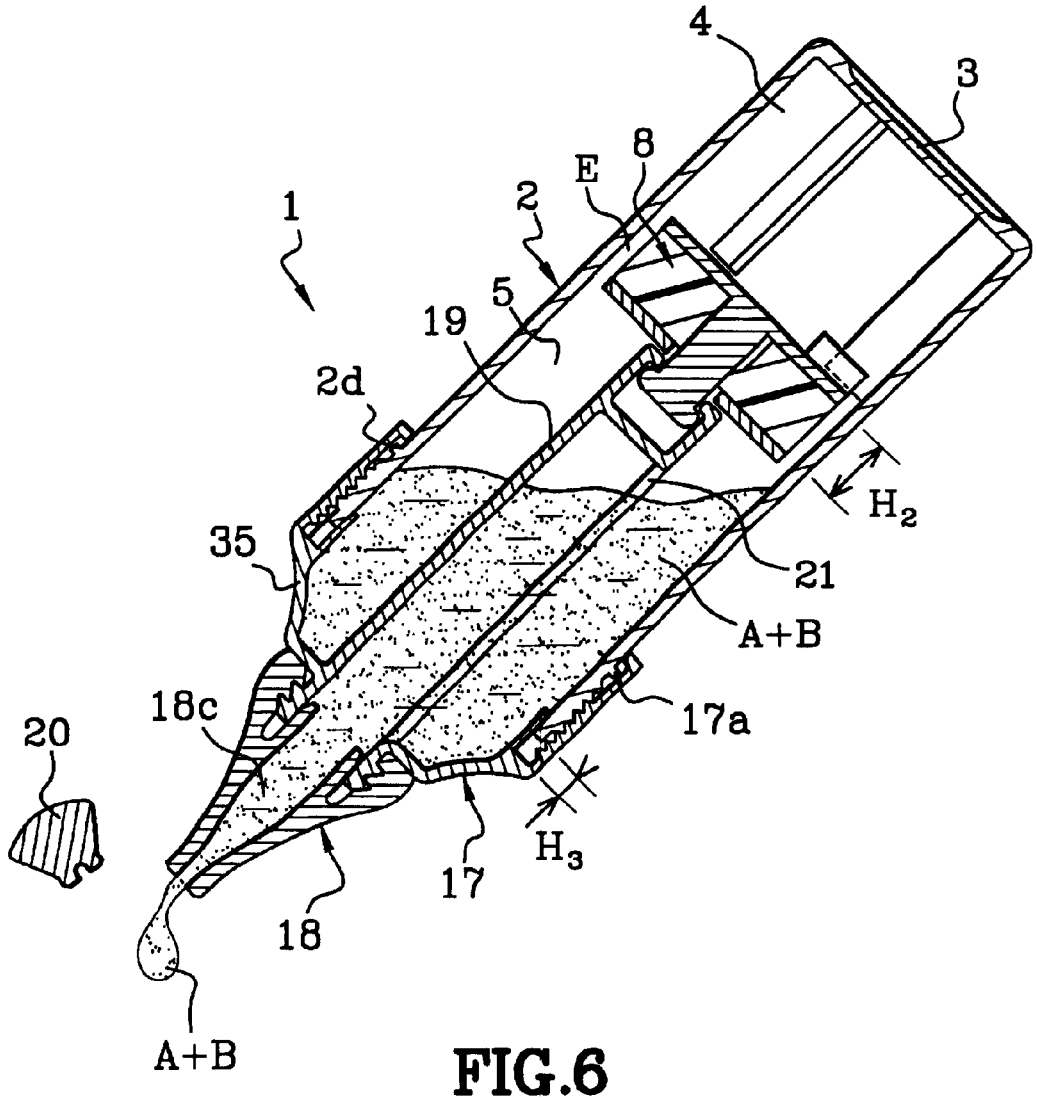
FIG. 6 is a cross-sectional view of the device of FIG. 1 during dispensing of the mixture.

Having removed the tab 20, the mixture A+B obtained can leave the container body 2 via the slots 21 and the dispensing attachment 18, as shown in FIG. 6. The tapered shape of the attachment 18 facilitates localized application of the mixture at a desired location. The attachment 18 connects by screw-fastening via an internal screwthread 18*b* onto the screwthread 32 of the neck 30 on the stem 19. A cylindrical sealing skirt 18*a* also is provided and presses radially against the interior wall of the neck 30.

Preferably, the body 2*a* of the container may be provided with at least one deformable portion, the compression of which facilitates the metered dispensing of the mixture A+B to be applied.

The device 1 is assembled and packaged as follows. First, the lower compartment 4 of the container 2 is filled with a component A, so that the fill level does not exceed the upper end 23*a* of the anti-rotation fins 23 (see FIG. 1).

After the elastic stopper 8 has been assembled between the base plate 7 and annular plate 9 of the compression element, the bulged portion 12 of the peg 11 is snap-fastened between the tabs 24*a*. By engaging the stopper member 8 inside the body 2*a,* the subassembly 7, 8, 9, and 19 thus formed is then driven axially toward the bottom 3. At this stage, the rim 17*a* is slipped over the screwthread 2*c* and, by screwing, the screwthread 17*b* of the cap 35 is engaged with the screwthread 2*c* of the body 2*a*. Once the cap 35 has been screwed fully on in the direction of the arrow $F_1$, the device 1 is in the storage configuration shown in FIG. 2. The sealing mechanism 7, 8, 9 then rests on the upper end 23*a* of the fins 23. The compressed stopper member 8, having a height $H_1$ and a radius $R_1$, seals the first compartment 4 from the compartment 5.

As shown in FIG. 3, an appropriate amount of a component B is then introduced into the second compartment 5 through the opening 30*a* of the neck 30. Once the dispensing attachment 18 has been screwed onto the neck 30 of the cap 35, as shown by the arrow $F_2$, the device 1 is reliably closed and can be placed on the market.

To use the device, the user turns the opening/closure member 17 of the actuator in the direction of the arrow $F_3$. During this operation, the cap 35 moves up axially by a height $H_3$ and drives the stem 19 axially upwards. This movement causes the base plate 7 and annular plate 9 of the compression element to unclamp the stopper 8. In effect, the screwthreads 2*c* of the container body 2*a* and of the opening/closure member 17 are shaped in such a way that the rotating of the cap 35 is accompanied by an upward axial displacement thereof sufficient to cause the stem 19 to move upward. The upward movement of the stem 19, once a sufficient travel $H_3$ has been covered, eliminates the downward force exerted on the annular plate 9 through the coupling member 24 and thus removes the compressive force on the stopper member 8, allowing stopper member 8 to expand axially and to contract radially, reducing its lateral cross-section.

Thus, through elasticity, the stopper reverts to its initial shape, decreasing its radius to $R_2$ and increasing its height by $H_3$. At this stage, the height $H_2$ of the stopper 8 therefore approximately equals $H_1+H_3$. An annular space E forms between the periphery of the decompressed stopper member 8 and the interior wall of the container body 2*a,* allowing the compartments 4 and 5 to be in flow communication with each other and the components A and B to be mixed together (see FIG. 5).

Preferably after shaking the device 1, causing a more homogenous mixture of the components A and B, the user cuts off the closure tab 20 and applies the mixture that flows from the upper compartment 4, through the hollow stem 19, and out of the dispensing attachment 18 at a desired location, as shown in FIG. 6.

Preferably, the dispenser device contains a cosmetic, pharmaceutical, or dermo-pharmaceutical product, more specifically a hair treatment product. However, in its broadest aspects, the present invention could be used to store and dispense many other types of flowable substances. Furthermore, sizes of various structural parts and materials used to make these parts are illustrative and exemplary only and one of ordinary skill in the art would recognize that these materials and sizes can be changed as necessary to product different effects or desired characteristics of the dispensing assembly.

It will be apparent to those skilled in the art that various modifications and variations can be made to the overall structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A device for dispensing a mixture of at least two components, comprising:

a container body defining at least two compartments;

a stopper member configured to selectively seal the two compartments from one another and place the two compartments in flow communication with one another; and an actuator operably coupled to the stopper member and configured to selectively place the stopper member from a storage position in which the two compartments are sealed from one another, to a mixing position in which the two compartments are in flow communication with one another, wherein the stopper member has a transverse cross-section in the storage position that is larger than a transverse cross-section of the stopper member in the mixing position.

2. The device of claim 1, wherein an interior of the container body has a cylindrical shape having a substantially uniform cross-section.

3. The device claim 1, wherein the stopper member is made of a material chosen from natural rubbers, synthetic rubbers, nitrile rubbers, butadiene rubbers, injectable thermoplastic rubbers, silicone rubbers, polyethylene foam, polyurethane foam, and polyester foam.

4. The device of claim 1, wherein the stopper member is made of a material with a Shore A hardness ranging from approximately 30 to approximately 90.

5. The device of claim 1, wherein at least a portion of the actuator is configured to move axially with respect to both the container body and the stopper member.

6. A method for using the device of claim 1, including mixing a hair composition in the device and dispensing the hair composition from the device.

7. The device of claim 1, wherein the stopper member includes an elastically deformable element.

8. The device of claim 7, wherein the stopper member includes an elastic material chosen from an elastomer and a closed-cell elastic foam.

9. The device of claim 1, wherein the actuator includes two compression elements, at least one of the compression elements being configured to move axially relative to the other compression element and the stopper member being disposed between the two compression elements.

10. The device of claim 9, wherein the compression elements are in the form of plates having a diameter less than an inner diameter of the container body.

11. The device of claim 1, further comprising a dispensing attachment in flow communication with at least one of the compartments.

12. The device of claim 11, further comprising a removable cap configured to close the dispensing attachment.

13. The device of claim 1, wherein the at least two compartments contain cosmetic components.

14. The device of claim 13, wherein the cosmetic components include compositions for treating hair.

15. The device of claim 1, wherein said container body has a closed bottom and wherein the container body is formed of a single piece of one of rigid material and semi-rigid material.

16. The device of claim 15, wherein the container body is made by one of injection blow-molding, extrusion blow-molding, single-material injection molding using polyvinyl chloride, and two-shot injection molding of two appropriate materials.

17. The device of claim 15, wherein the container body is made of a polyethylene/polyvinyl alcohol/polyethylene complex.

18. The device of claim 1, wherein the actuator is configured to apply axial compression to the stopper member to place the stopper member in the storage position.

19. The device of claim 18, wherein said axial compression causes an increase in the cross-section of the stopper member relative to a cross-section of the stopper member absent the axial compression.

20. The device of claim 19, wherein the increase in cross-section of the stopper member places a lateral surface of the stopper member in sealing engagement with an inner portion of said container body.

21. The device of claim 19, wherein an outer diameter of the stopper member absent axial compression is less than an inner diameter of the container body at an axial location corresponding to the stopper member.

22. The device of claim 1, further comprising an outlet orifice in flow communication with at least one of said compartments, said outlet orifice being configured to dispense the mixture.

23. The device of claim 22, further comprising a hollow stem configured to place at least one of the compartments in flow communication with the outlet orifice.

24. The device of claim 23, wherein the stem communicates with the at least one compartment through at least one opening formed on an outer surface of the stem.

25. The device of claim 23, wherein the actuator includes the stem.

26. The device of claim 1, wherein a first movement of at least a portion of the actuator places the stopper member in the storage position and a second movement of the portion of the actuator opposite to the direction of the first movement places the stopper in the mixing position.

27. The device of claim 26, wherein the actuator includes a rotatable closure member and the first movement rotates the closure member in a first direction and the second movement rotates the closure member in the second opposite direction.

28. The device of claim 27, wherein the rotatable closure is coupled to compression elements for axially compressing and decompressing the stopper member in response to rotation of the rotatable closure.

29. The device of claim 28, further comprising a stop mechanism configured to limit rotation of at least one of the compression elements with respect to the container body.

30. The device of claim 1, wherein the actuator includes a threaded portion configured to be in threaded engagement with the container body.

31. The device of claim 30, wherein the threaded portion is configured to rotate with respect to the container body in a first direction to place the stopper in the storage position and in a second direction to place the stopper in the mixing position.

32. The device of claim 30, wherein rotation of the threaded portion with respect to the container body imparts axial motion to at least a portion of the actuator relative to both the container body and to the stopper member.

33. The device of claim 32, wherein the actuator includes compression elements configured to selectively compress and decompress the stopper member in response to said axial motion.

34. The device of claim 33, wherein the compression elements include two compression plates and the stopper member is disposed between said two plates.

35. The method of using the device of claim 1, comprising:

providing a first component in the first compartment and a second component in the second compartment;

maintaining the compartments sealed from one another;

reducing the cross-section of the stopper member to place the first and second compartments in flow communication with one another;

mixing the components together; and dispensing the mixture.

36. The method of claim 35, wherein the maintaining of the compartments sealed from one another includes compressing the stopper member.

37. The method of claim 35, wherein the reducing of the cross-section of the stopper member includes removing an axial compressive force from the stopper member.

38. The method of claim 35, wherein the actuator includes two compression elements and the reducing of the cross-section of the stopper member includes moving at least one of the compression elements axially with respect to the other compression element.

39. The method of claim 35, wherein the reducing of the cross-section of the stopper member includes moving at least a portion of the actuator in a first direction.

40. The method of claim 39, wherein the actuator includes a rotatable closure member and the moving of at least a portion of the actuator includes rotating the closure member with respect to the container body.

41. The method of claim 40, wherein the rotating of the closure member causes at least a portion of the actuator to move axially with respect to the container body and the stopper member.

42. A device for dispensing a mixture of at least two components, comprising:

a container defining at least two compartments;

a stopper member configured to selectively seal the two compartments from one another and place the two compartments in flow communication with one another; and an actuator operably coupled to the stopper member and configured to selectively move the stopper member from a storage position in which the two compartments are sealed from one another, to a mixing position in which the two compartments are in flow communication with one another, wherein the stopper member has a height in the storage position that is smaller than a height of the stopper member in the mixing position.

43. The device of claim 42, wherein the stopper member includes an elastically deformable element.

44. The device of claim 42, wherein an interior of the container body has a cylindrical shape having a substantially uniform cross-section.

45. A method for using the device of claim 42, including mixing a hair composition in the device and dispensing the hair composition from the device.

46. The device of claim 42, wherein the actuator includes two compression elements, at least one of the compression elements being configured to move axially relative to the other compression element and the stopper member being disposed between the two compression elements.

47. The device of claim 46, wherein the compression elements are in the form of plates having a diameter less than an inner diameter of the container body.

48. The device of claim 42, wherein the at least two compartments contain cosmetic components.

49. The device of claim 48, wherein the cosmetic components include compositions for treating hair.

50. The device of claim 42, wherein the actuator is configured to apply axial compression to the stopper member to place the stopper member in the storage position.

51. The device of claim 50, wherein said axial compression causes an increase in a transverse cross-section of the stopper member relative to a transverse cross-section of the stopper member absent axial compression.

52. The device of claim 51, wherein a diameter of the stopper member absent the axial compression is less than an inner diameter of the container body at an axial location corresponding to the stopper member.

53. A device for dispensing a mixture of at least two components, comprising:

a container body defining at least two compartments;

a stopper member configured to selectively seal the two compartments from one another and place the two compartments in flow communication with one another; and an actuator operably coupled to the stopper member and configured to selectively cause repositioning of the stopper member from a storage position in which the two compartments are sealed from one another, to a mixing position in which the two compartments are in flow communication with one another, wherein at least a portion of the stopper member remains in approximately the same axial position relative to the container body in both the storage position and the mixing position.

54. The device of claim 53, wherein another portion of the stopper member moves axially with respect to the container body to place the stopper member in the storage and mixing positions.

55. The device of claim 53, wherein the bottom of the stopper member remains in approximately the same axial position relative to the container body.

56. The device of claim 53, wherein the stopper member includes an elastically deformable element.

57. The device of claim 53, wherein an interior of the container body has a cylindrical shape having a substantially uniform cross-section.

58. A method for using the device of claim 53, including mixing a hair composition in the device and dispensing the hair composition from the device.

59. The device of claim 53, wherein the actuator includes two compression elements, at least one of the compression elements being configured to move axially relative to the other compression element and the stopper member being disposed between the two compression elements.

60. The device of claim 59, wherein the compression elements are in the form of plates having a diameter less than an inner diameter of the container body.

61. The device of claim 53, wherein the at least two compartments contain cosmetic components.

62. The device of claim 61, wherein the cosmetic components include compositions for treating hair.

63. The device of claim 53, wherein the actuator is configured to apply axial compression to the stopper member to place the stopper member in the storage position.

64. The device of claim 63, wherein said axial compression causes an increase in a cross-section of the stopper member relative to a cross-section of the stopper member absent axial compression.

65. The device of claim 64, wherein the increase in cross-section of the stopper member places a lateral surface of the stopper member in sealing engagement with an inner portion of said container body.

66. The device of claim 64, wherein a diameter of the stopper member absent the axial compression is less than an inner diameter of the container body at an axial location corresponding to the stopper member.

* * * * *

UNITED STATES PATENT AND TRADEMARK OFFICE

CERTIFICATE OF CORRECTION

PATENT NO. : 6,293,433 B1
DATED : September 25, 2001
INVENTOR(S) : Gérard Joulia It is certified that error appears in the above-identified patent and that said Letters Patent is hereby corrected as shown below:

Column 9, claim 3,
Line 57, insert -- of -- before "claim 1".

Signed and Sealed this

Ninth Day of April, 2002

*Attest:*

*Attesting Officer*

JAMES E. ROGAN
*Director of the United States Patent and Trademark Office*